United States Patent [19]

Nare et al.

[11] Patent Number: 4,922,931

[45] Date of Patent: May 8, 1990

[54] PORTABLE SMOKE RETENTION DEVICE

[76] Inventors: Donald H. Nare, 16 Willett St., Fort Plain, N.Y. 13339; Albert L. Schmeiser, 4 Woodview Ct., Ballston Lake, N.Y. 12019

[21] Appl. No.: 269,984

[22] Filed: Nov. 9, 1988

[51] Int. Cl.[5] ..... A24D 1/02; A24F 7/00; A24F 7/02

[52] U.S. Cl. ..... 131/211; 131/215.1; 131/215.3; 131/216; 131/223; 131/329

[58] Field of Search ..... 131/330, 212.2, 212.1, 131/212.1, 213, 215.1, 215.2, 215.3, 216, 223, 211

[56] References Cited

U.S. PATENT DOCUMENTS 3,805,806 4/1974 Grihalua .
3,918,464 11/1975 Kolodziej .
4,172,460 10/1979 Robertson .
4,198,992 4/1980 Smith .
4,369,798 1/1983 Jackson ..... 131/212.1
4,685,477 8/1987 Valdez .

*Primary Examiner*—V. Millin
*Attorney, Agent, or Firm*—Schmeiser, Morelle & Watts

[57] ABSTRACT

A smoke retention device having a collapsible chamber and an insert threadable into said collapsible chamber for holding a combustible material. A bag is secured over one end of the chamber and held in place by an elastic band. Valve mechanisms allow the user to draw air through the insert said air being directed through the combustible material and exhaling air back to the insert said exhaled air being directed through a second aperture back into the container.

5 Claims, 1 Drawing Sheet

PORTABLE SMOKE RETENTION DEVICE

FIELD OF THE INVENTION

Generally this invention relates to smoking devices. More particularly, this invention is a portable smoke retention device for smoking cigarettes or pipe tobacco without emitting smoke into the atmosphere.

BACKGROUND OF THE INVENTION

In recent years it has become evident that the hazards of smoking are not only the concern of those who smoke but also those who breathe in smoke. For this reason numerous laws, regulations and policies have been established which either limit the areas in which an individual can smoke or else ban smoking completely. This is course can be extremely troublesome for smokers who tend to rely on smoking as a diversion, or to relax. When these individuals are not allowed to smoke they tend to become tense and nervous and often have difficulty concentrating on the other things that they are doing. This is especially troublesome in the workplace where smokers may have been in the habit of smoking while working. The individuals now find themselves confined to nonsmoking areas which has a double negative effect. The first part of the negative effect is a difficulty in performing ones work when ones attention is being distracted by the need for a cigarette. Secondly, if they wish to smoke they must stop whatever they are working on and remove themselves to a designated smoking area.

From the nonsmokers point of view many would have trouble concentrating on their work if someone in the vicinity were smoking. Furthermore, they would be subject to health risks for decisions which they were not making. The nonsmoker therefore often finds it extremely annoying if placed in a location near to a smoker.

While it may initially appear that these conflicts cannot be resolved to the satisfaction of both this problem is in fact solved with the subject invention.

Prior attempts to satisfy both the nonsmoker or smoker have resulted in designating smoking and nonsmoking areas. Other considerations include coffee brakes in order to allow the worker to partake of his habit. These of course are less desirable for the employer who looses valuable work time not only during the brake but for the time just prior and after the brake while the individual is not concentrating on their work.

While the work area is a clear example of this problem one need not look far to recognize other significant examples. Eating establishments are another good example. While many eating establishments have designated smoking areas, those who are truly sensitive to smoke will generally say that these areas are not sufficiently removed in order to really protect them from the smoke. Furthermore, the nonsmoker will say that he or she cannot enjoy their meal when in the presence of smoke and conversely the smoke will explain how his meal is not complete unless he is also able to have a cigarette.

Other areas such as beauty salons, waiting rooms of any type, etc. are all places for possible conflict and dissatisfaction both on the part of the smoker and nonsmoker. It was with these ideas in mind that the subject invention was developed in order to respect the rights, needs and wants of all individuals involved.

These needs have not been previously met since other smoking devices such as water pipes and the like may retain the smoke from the burning cigarette but fail to consider the exhaled smoke by the user. This is a common shortcoming of the prior art and renders all of these approaches useless when trying to maintain a smoke free atmosphere.

SUMMARY OF THE INVENTION

The subject invention meets the need of both the smoker and nonsmoker by providing a virtually air tight container for smoke. In order to meet the needs of both the smoker and nonsmoker it became necessary to address two smoke sources, the burning cigarette and exhaled smoke.

This was accomplished by developing a dual purpose container and insert which retains the smoke exiting from the burning cigarette while providing a simple container for exhaled smoke. The subject invention utilizes an insert having two valves so that air drawn from the container through the insert is directed through the combustible material and to the user. Conversely, air exhaled from the user is directed from the insert through a second passageway and valve system directing the exhaled smoke back into the container.

This invention also solves the problem of collapsing the container when air is constantly being drawn out through the combustible means but not returned to the container. The subject invention was developed to be compact having a two piece container, one piece being a collapsible chamber and the other a bag secured about the opening at one end of the chamber. Thus, the smoker may carry the device in a jacket pocket and inflate the bag and extend the chamber prior to inserting the lit cigarette.

DETAILED DESCRIPTION OF THE DRAWINGS

Figure 1:
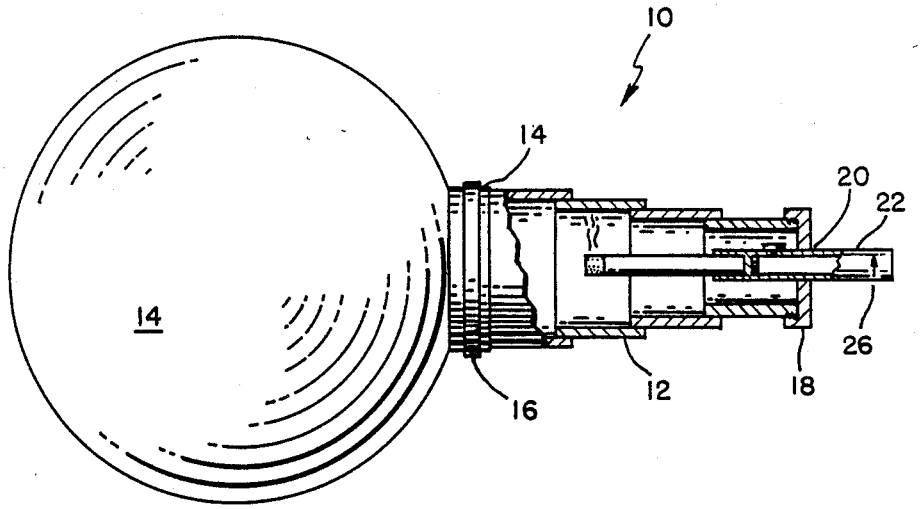
FIG. 1 is a side elevational view with a partial break away.

FIG. 1 discloses the smoke retention device generally designated as 10. The device consists of two main parts, a collapsible chamber 12 which is of a telescoping design, the chamber being open at each end. A bag 14 is secured over the larger end of the collapsible chamber 12 and secured by an elastic band 16. The bag of may be made of many different materials but in may preferred embodiment it is simply a plastic bag which is nonelastic since elasticity would tend to force the air out of the collapsible chamber 12.

The outer circumference of the small end of the collapsible chamber 12 is externally threaded. An internally threaded cap 18 is part of the insert designated generally as 20. Extending through the end cap is a tube 22 which defines a central conduit 24. On the external surface of the tube 22 is an arrow 26 which notifies the user to continue rotating the end cap 18 upon the externally threaded end of the collapsible chamber untl the end cap is secure and the arrow is pointing in an upward direction. This is done in order to assure that the various valve mechanisms are in the right location prior to use. However the device will still function satisfactorily even if the arrow is not pointing upward.

The tube 22 may be divided into two sections. That which forms the central conduit 24 and the other end of the tube which is a holder 28 and for combustible materials. The holder 28 and the central conduit 24 are separated by a shoulder 30 but communicate with each other through a first aperture 32 in said shoulder 30. In my preferred embodiment a cigarette 34 may simply be placed into the holder 28. However, it is also anticipated that the holder 28 could be configured with a bowl (not shown) in order to smoke tobacco as one would with a pipe.

Figure 2:
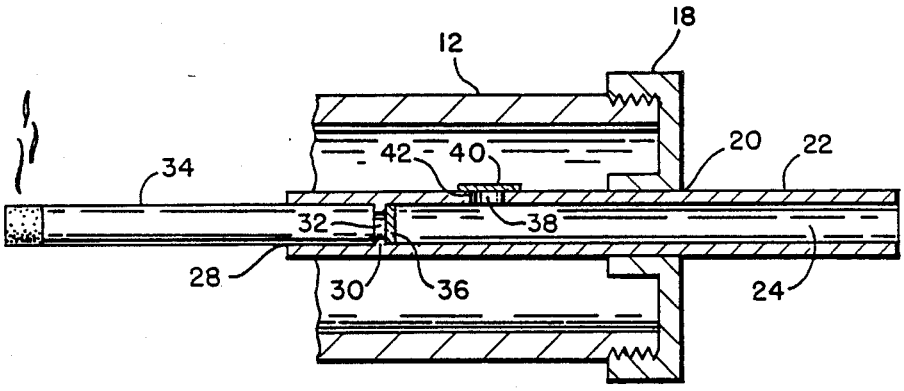
FIG. 2 is an exploded view in cross section of the insert and valving means.

As shown in greater detail in FIG. 2 the first aperture is covered by a first valve 36 which in my preferred embodiment is simply made from a thin rubber flap which is secured at one end to the shoulder 30 and therefore biased to a closed position where it blocks the first aperture. When air is drawn by the user through the central conduit 24 air within the chamber 12 and bag 14 will enter through the combustible material and through the first aperture 32, the drawing pressure being sufficient to move the first valve to an open position where the smoke exits the retention device 10 through the central conduit 24.

When positioned with the arrow 26 pointing upwardly the tube 22 has an upwardly opening second aperture 38 for communication between the central conduit 24 and the inside of the smoke retention device 10. A second flap 40 which again may be made from a thin rubber material is secured along one edge to the outer surface to tube 22 so that the second aperture is closed. It should be appreciated that the second flap 40 is also biased to a closed position due to the inherent characteristics of the rubber flap and therefore this second valve 42 is maintained in a closed position until air is blown into the central conduit 24 from outside the device 10. This then moves the second valve 42 to its open position directing the exhaled smoke back into the device 10.

In operation, when the user first decides to use the device he extends the collapsible chamber 12 and attaches a bag 14 over the larger end of the chamber by means of an elastic band 16. The user simply inserts the cigarette into holder 28 afterwhich he lights the cigarette and draws air through the central conduit 24. He thereafter threads the end cap 18 onto the collapsible chamber 12 with the arrow 26 pointing upwardly. The user then exhales the smoke by blowing into central conduit 24 which moves the second valve 24 to an open position, the exhaled smoke raising the second flap 40 and traveling through the second aperture 38 into the smoke retention device. The user then blows the bag up through the insert but since the bag is not elastic it will simply be blown up to its fully extended position as shown in FIG. 1. The user then draws through the central conduit 24 wherein the first valve 36 moves to an open position and air is drawn through the combustible material, through the first aperture 32 and to the user.

When the user is done smoking he simply waits until the cigarette extinguishes itself due to lack of oxygen and then collapses the chamber 12. This locates the remainder of the cigarette 34 within the bag 14. Elastic band 16 is removed and with a pinching action the user removes the bag 14 from the collapsible chamber and in so doing also removes the cigarette 34 from the holder 28. The bag filled with smoke may then be tied off and discarded with only a minimum of smoke entering the atmosphere. While the above describes the preferred embodiment it is anticipated that many variations may be made without departing from the intent of this invention which may be realized through use of the invention. only by the appended claims.

We claim:

1. A portable smoke retention device comprising:

a container having a chamber opened at each end and having a bag secured over one end of the chamber;

an insert secured to the chamber through the chamber opening opposite the bag, said insert having a combustible material holder and a passageway through the combustible material holder and the insert to the exterior of said container;

first valve means in said insert movable between and open position when air is drawn from the bag through the chamber and the insert and a closed position when air is blown through the insert and the chamber into the bag; and a second valve means in said insert movable between an open position when air is blown through said insert into, and through the chamber into the bag, bypassing the combustible material holder, and a closed position when air is drawn from the bag through the chamber and the insert.

2. The invention of claim 1 where the first and second valve means are biased to the closed position.

3. The invention of claim 1 wherein said chamber is collapsible.

4. The invention of claim 1 wherein said insert further comprises:

a central passageway;

a first aperture at the end of said passageway, said first aperture being covered by the first valve;

a receptacle for receiving combustible material communicating with the first aperture and on the side of the first aperture opposite said passageway; and a second aperture leading from the passageway into the container, said second aperture being covered by said second valve means.

5. The invention of claim 4 wherein the valve means further comprises a first flap being secured within the passageway over said first aperture; and a second flap secured on the outer surface of the insert over said second aperture.

* * * * *